US010633841B2

(12) United States Patent
Mu et al.

(10) Patent No.: US 10,633,841 B2
(45) Date of Patent: Apr. 28, 2020

(54) PULL-OUT WATER OUTLET APPARATUS

(71) Applicant: XIAMEN SOLEX HIGH-TECH INDUSTRIES CO., LTD., Xiamen, Fujian (CN)

(72) Inventors: Weihai Mu, Fujian (CN); Chunjie Hong, Fujian (CN); Wenxing Chen, Fujian (CN); Canhui Zhu, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 116 days.

(21) Appl. No.: 15/964,673

(22) Filed: Apr. 27, 2018

(65) Prior Publication Data

US 2018/0340318 A1 Nov. 29, 2018

(30) Foreign Application Priority Data

May 25, 2017 (CN) ..... 2017 1 0388831

(51) Int. Cl.
*F15B 13/00* (2006.01)
*E03C 1/04* (2006.01)

(52) U.S. Cl.
CPC .... *E03C 1/0404* (2013.01); *E03C 2001/0414* (2013.01); *E03C 2001/0415* (2013.01); *Y10T 137/9464* (2015.04)

(58) Field of Classification Search
CPC ..... Y10T 137/9464; E03C 1/0404; E03C 2001/0415
USPC ..... 239/588; 251/288
See application file for complete search history.

(56) References Cited

U.S. PATENT DOCUMENTS 6,810,539 B2 * 11/2004 Bosio ..... E03C 1/04 4/675
6,877,172 B2 * 4/2005 Malek ..... E03C 1/0404 239/587.1
2012/0042973 A1 * 2/2012 Ko ..... E03C 1/0404 137/801
2014/0166124 A1 * 6/2014 Davidson ..... E03C 1/0404 137/315.01
2016/0237663 A1 * 8/2016 Myers ..... E03C 1/0404
2017/0292252 A1 * 10/2017 Mu ..... E03C 1/0404

FOREIGN PATENT DOCUMENTS

CN 202546003 U 11/2012
CN 105756143 A 7/2016

* cited by examiner

*Primary Examiner* — Robert K Arundale
(74) *Attorney, Agent, or Firm* — Cooper Legal Group, LLC

(57) ABSTRACT

A pull-out water outlet apparatus has a support mechanism and a water outlet mechanism with a water outlet portion. A pull hose connected to the end of the water outlet extends from the support mechanism port into the support mechanism, the water outlet mechanism has a guide means, the inner wall of the support mechanism has a guide groove, wherein the guide means includes a leading portion extending from the outer rotary wall of the water outlet mechanism and at least one auxiliary portion, the height that the leading portion extends out of the outer rotary wall is greater than the height that the auxiliary portion extends out of the outer rotary wall. The inner wall of the support mechanism has a portion for recessing the guide groove and a rest portion, the guide groove leads to the support mechanism port and forms the guide groove inlet.

17 Claims, 12 Drawing Sheets

PULL-OUT WATER OUTLET APPARATUS

FIELD OF INVENTION

The present invention relates to a water outlet apparatus, and more particularly to a pullable pull-out water outlet apparatus.

BACKGROUND OF INVENTION

The pull-out water outlet apparatus comprises a support mechanism and a water outlet mechanism, the water outlet mechanism includes a water outlet portion and a pull hose connected to the end of the water outlet, the pull hose extends from the support mechanism port into the support mechanism; a pull-back mechanism connect to the pull hose is equipped, the pull-back mechanism can apply a pull-back force to the pull hose to pull the water outlet mechanism back to the support mechanism after the user pulls out the water outlet mechanism, if the pull hose is connected to heavy objects, the pull-back mechanism can make use of heavy gravity to produce back force. In the existing pull-out water outlet apparatus, such as: CN105756143A, the water outlet mechanism has two guide means, the inner wall of the support mechanism has two guide grooves, to achieve the automatic guide when pull back through the two guide means cooperating with the two guide grooves, the apparatus has the following deficiencies: the side of the button can not be guaranteed to be on the desired side (such as the front side) when pull back, that is, the button side may be located on the front side, or on the back; in CN202546003U, the support mechanism is provided with an inclined surface, and the water outlet mechanism is provided with an inclined surface, using the alignment of two inclined surfaces to achieve positioning, the apparatus has the following deficiencies: the apparatus can not automatically guide the alignment, the user need manual alignment and then reset, it is not inconvenient for operation; in CN205894180U, the support mechanism is provided with a groove, the water outlet mechanism is provided with a projection, and the positioning is realized by the cooperation of the projection and the groove, the apparatus has the following deficiencies: the apparatus can not automatically guide the alignment, the user need manual alignment and then reset, it is not inconvenient for operation.

SUMMARY OF THE INVENTION

The present invention provides a pullable water outlet apparatus which overcomes the shortcomings of the pullable pull-out water outlet apparatus in the background art.

The technical solution adopted by the invention to solve the above technical problem is that, A pull-out water outlet apparatus, comprising a support mechanism and a water outlet mechanism, the water outlet mechanism comprises a water outlet portion and a pull hose connected to the end of the water outlet, the pull hose extends from the support mechanism port into the support mechanism, the water outlet mechanism has a guide means, the inner wall of the support mechanism has a guide groove, the guide means comprises a leading portion extending from the outer rotary wall of the water outlet mechanism and at least one auxiliary portion, the height that the leading portion extends out of the outer rotary wall is greater than the height that the auxiliary portion extends out of the outer rotary wall; the inner wall of the support mechanism has a portion for recessing the guide groove and a rest portion, the guide groove leads to the support mechanism port and forms the guide groove inlet, the leading portion can be moved to the deepest position by the guiding action of the guide groove and can stabilize the movement of the water outlet mechanism through the leading portion and the auxiliary portion respectively relying to the bottom of the guide groove and the rest portion of the inner wall.

As a preferred embodiment of the present invention, the bottom of the guide groove is provided with a limiting groove for fitting the leading portion.

As a preferred embodiment of the present invention, the guide groove has two groove walls extending from the deepest portion of the guide groove to the both sides of the end toward the port of the rest portion of the inner wall respectively, the groove wall constitutes the guide surface.

As a preferred embodiment of the present invention, the end of the rest portion of the inner wall is directed toward the port and is set as a guide structure.

As a preferred embodiment of the present invention, the central angle of the inlet of the guide groove is 360 degrees.

As a preferred embodiment of the present invention, the leading portion comprises a connecting shaft which is attached to the water outlet mechanism and which extends partially out of the outer rotary wall and a bearing that is connected to the extending part of the connecting shaft.

As a preferred embodiment of the present invention, the auxiliary portion comprises a ball which is arranged to roll with respect to the water outlet mechanism, the ball portion extends partially out of the outer rotary wall.

As a preferred embodiment of the present invention, the outer peripheral wall of the water outlet portion is provided with a main fitting groove, and the main fitting groove is concave, and a loop is fitted to connect to the outer peripheral wall of the water outlet portion, the loop is provided with a first main hole through inside and outside, the diameter of the first main hole is larger than the diameter of the main fitting groove port; the main fitting groove is adapted to have a connecting head, one end of the connecting shaft is through the first main hole and mounted on the connecting head; and the outer peripheral wall of the loop constitutes the outer rotary wall.

As a preferred embodiment of the present invention, the outer peripheral wall of the water outlet portion is provided with at least one auxiliary fitting groove and the auxiliary fitting groove is concave, and a loop is fitted to connect to the outer peripheral wall of the water outlet portion, the loop is provided with a first auxiliary hole through inside and outside, and the inner of the auxiliary fitting groove is provided with the ball, the outer diameter of the ball is not greater than the diameter of the fitting groove and is larger than the diameter of the first auxiliary hole; the outer peripheral wall of the loop constitutes the outer rotary wall.

As a preferred embodiment of the present invention, the water outlet portion includes an inner core forming a water flow passage and a ball holder fixed to the inside of the inner core, the inner core is provided with a second main hole, and the second main hole and the water flow passage of the inner core are sealed through the ball holder cooperating with the sealing ring, and the ball holder and the second main hole cooperate to constitute the main fitting groove.

As a preferred embodiment of the present invention, the water outlet portion includes an inner core forming a water flow passage and a ball holder fixed to the inside of the inner core, the inner core is provided with a second auxiliary hole, and the second auxiliary hole and the water flow passage of the inner core are sealed through the ball holder cooperating with the sealing ring, and the ball holder and the second auxiliary hole cooperate to constitute the auxiliary fitting groove.

As a preferred embodiment of the present invention, the support mechanism comprises a support tube and a socket, the socket is fitted into the front end of the support tube, the socket has a receiving cavity which has openings at both ends along the length of the support tube, and the inner wall of the receiving cavity is formed with the inner wall of the support mechanism; and the end of the socket is provided with a magnetizing means for generating magnetic attraction to the water outlet mechanism.

Compared with the background art, the technical solution has the following advantages:

The guide means comprises a leading portion and at least one auxiliary portion, the height of the extending from the outer rotary wall of the leading portion is greater than the height of the extending from the outer rotation wall of the auxiliary portion, so that the leading portion can automatically fall into the guide groove during the pull-back, and the auxiliary portion is automatically moved to the rest of the inner wall, so that the leading portion can be moved to the deepest position by the guiding action of the guide groove, and the movement of the water outlet mechanism can be stabilized by the leading portion and the auxiliary portion leading to the guide groove bottom and inner wall of the rest portion respectively. So that the water discharge mechanism can be guided to a pre-set unique position to overcome the deficiencies in the background art and to move smoothly.

At the deepest portion of the guide groove there is provided a restriction groove in order to limit the water outlet apparatus at the deepest.

The end of the port of the rest of the inner wall is set as a guide means to further ensure that the leading portion moves into the guide groove.

The leading portion includes a connecting shaft which is attached to the water outlet mechanism and which partially extends out of the outer rotary wall and a bearing connected to the projecting portion of the connecting shaft so as to reduce the frictional force of the leading portion and the groove wall and further ensure that the leading portion moves to the guide groove and moves along the groove wall.

The guide portion includes a ball which is arranged to roll with respect to the water outlet mechanism, both to reduce the frictional force of the auxiliary portion and the rest of the inner wall and to further ensure that the leading portion moves into the guide groove and moves along the wall to ensure that the auxiliary portion moves in the rest of the inner wall.

And a loop is fitted to the outer peripheral wall of the water outlet portion, the outer peripheral wall of the loop constitutes the outer rotary wall described above, and the assembling is convenient and the structure is simple.

The water outlet portion includes an inner core forming a water flow passage and a ball holder fixed to the inner core, the ball holder and the second main hole are configured to constitute the main fitting groove, the ball holder and the second auxiliary hole are configured to constitute the auxiliary fitting groove, and the assembling is convenient and the structure is simple.

DESCRIPTION OF THE DRAWINGS

The invention will now be further described with reference to the accompanying drawings and embodiments.

DETAILED DESCRIPTION OF THE PREFERRED EMBODIMENTS

Figure 1:
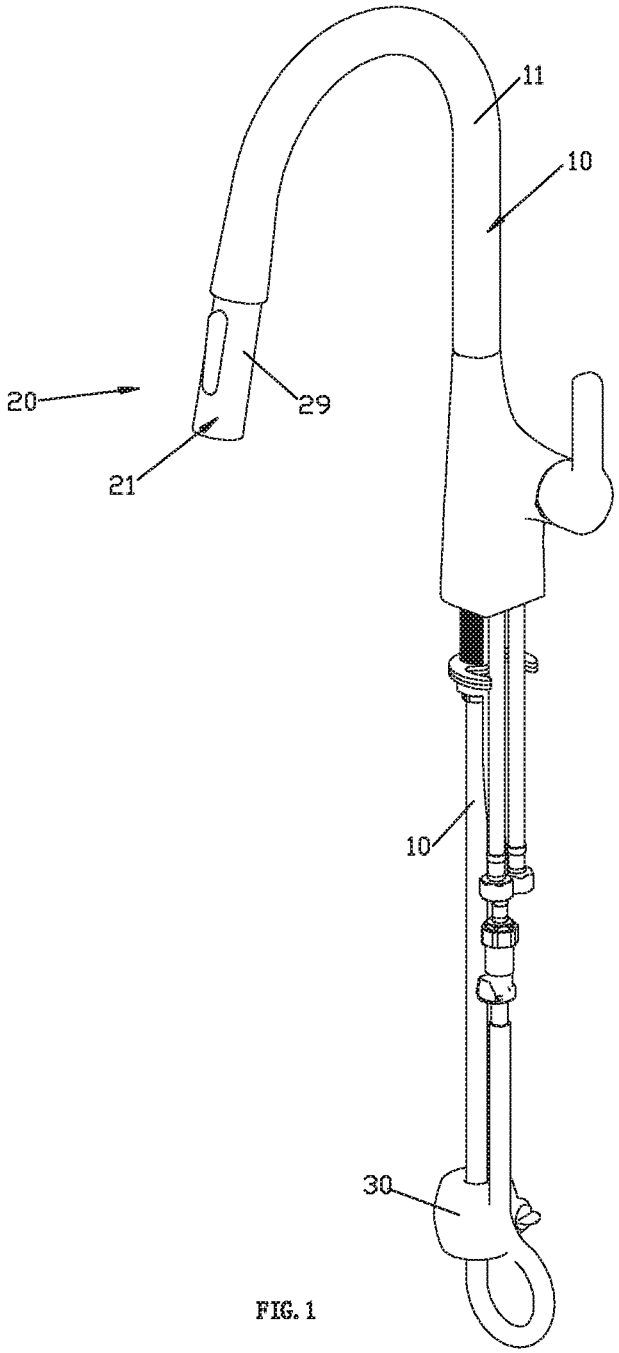
FIG. 1 is a schematic view of the three-dimensional structure of the water outlet apparatus.
Figure 2:
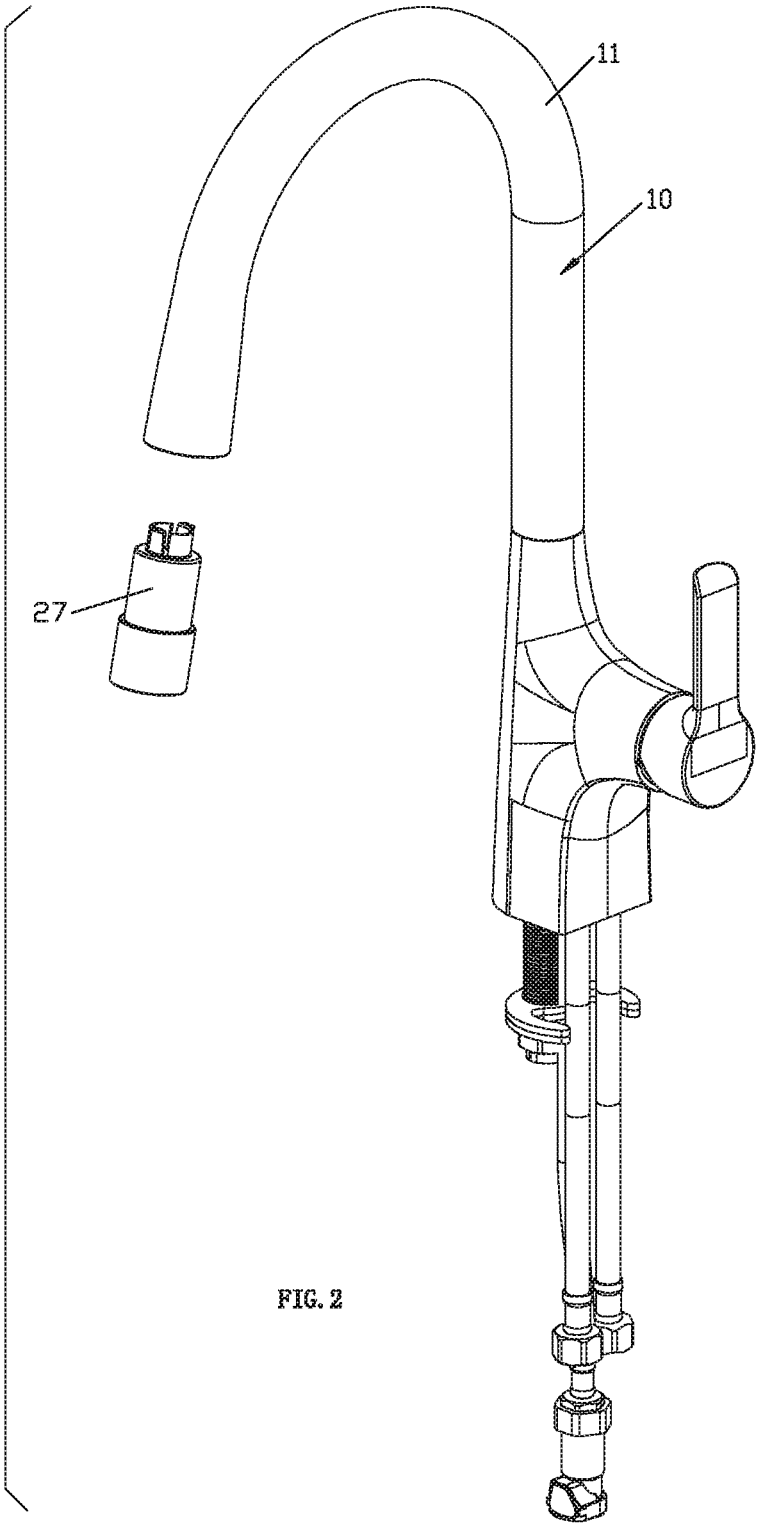
FIG. 2 is a partial decomposition of the water outlet apparatus.
Figure 3:
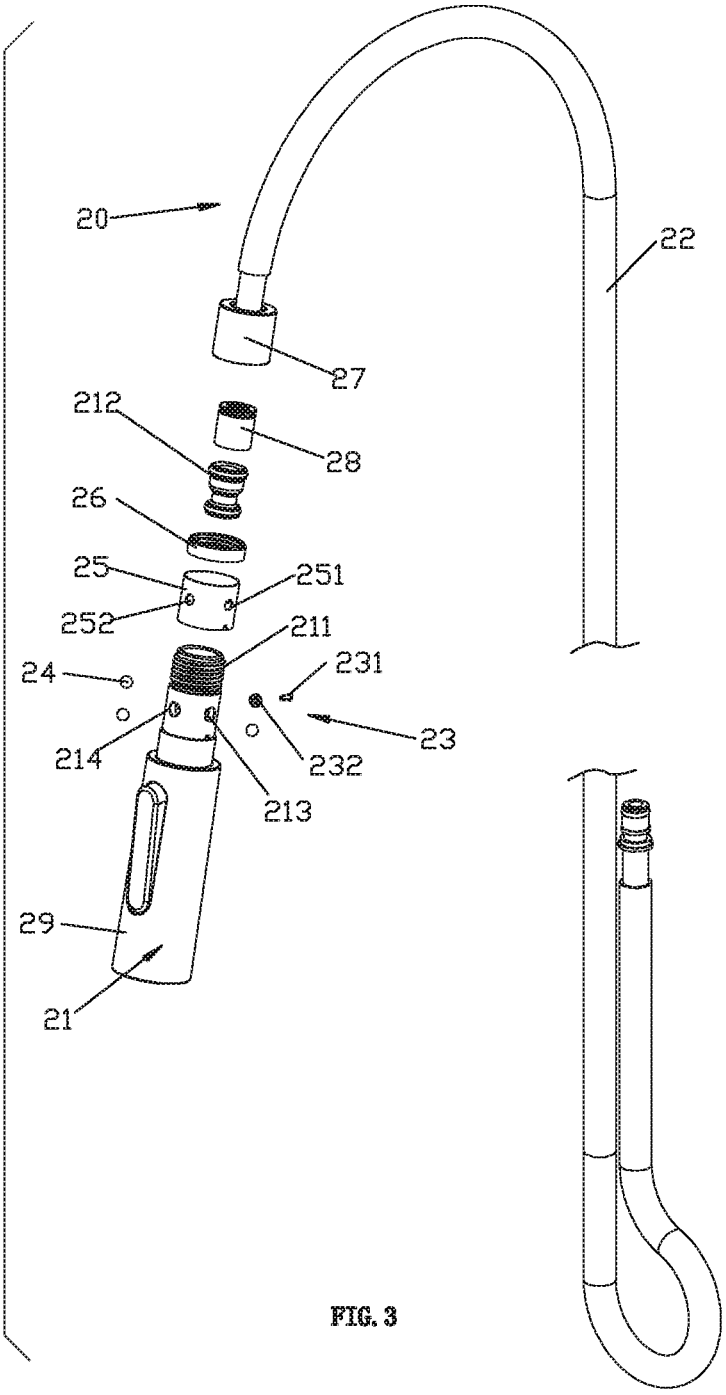
FIG. 3 is the three-dimensional decomposition diagram of the water outlet mechanism and the pull hose.

Referring to FIGS. 1 to 12, the water outlet apparatus includes a support mechanism 10, a water outlet mechanism 20 and a pull back mechanism 30.

The support mechanism 10 includes a support tube 11 and a socket 12, the socket 12 is fitted into the front end of the support tube 11, the socket 12 has a receiving cavity which has openings at both ends along the length of the support tube 11. The water outlet mechanism 20 includes a water outlet portion 21 and a pull hose 22 connected to the end of the water outlet portion 21. The pull hose 22 extends from the port of the support mechanism 10 into the support mechanism 10. The pull back mechanism 30 includes a weight, the weight is attached to the pull hose 22 to convert its own gravity into a pull-back force.

The water outlet mechanism 20 is provided with a guide means, the guide means includes a leading portion 23 extending from the outer rotary wall of the water outlet mechanism 20 and at least one auxiliary portion 24, the height that the leading portion 23 extends out of the outer rotary wall is greater than the height that the auxiliary portion 24 extends out of the outer rotary wall; and the socket 12 of the inner wall of the support mechanism 10 is provided with a guide groove 13, the socket 12 of the inner wall of the support mechanism 10 is provided with a portion for recessing the guide groove 13 and a rest portion 14.

The guide groove 13 leads to the support mechanism 10 port and forms the guide groove inlet 131, the guide groove inlet 131 has a width greater than the height of the leading portion 23 extending beyond the outer rotary wall so that the leading portion 23 is engaged with the guide groove inlet 131; and the guide portion 23 can be moved to the deepest portion by the guiding action of the guide groove 13, and can stabilize the water outlet mechanism 20 by the guide portion 23 and the auxiliary portion 24 relying on the bottom of the guide groove 13 and the rest portion of the inner wall 14 respectively. Preferably, the deepest portion of the guide groove 13 is provided with a restriction groove 133 adapted to guide the leading portion 23, the leading portion 23 moves into the restriction groove 133 when the leading portion 23 moves to the deepest portion to function as positioning the outlet water mechanism.

A specific structure of the guide groove 13 is that the guide groove 13 has two groove walls 132 extending continuously from the deepest portion of the guide groove 13 to the both sides of the end 141 toward the port of the rest portion 14 of the inner wall respectively, the groove wall 132 constitutes the guide surface. In the present embodiment, the groove wall is arranged along a spiral line, and the two groove walls are arranged symmetrically with a helix angle of slightly less than 180 degrees. Preferably, the rest portion 14 of the inner wall is oriented toward the end 141 of the port, and is set as a guide structure, the guide structure is set to a taper angle. Or the center angle of the inlet of the guide groove 13 is 360 degrees.

In a preferred embodiment, the leading portion 23 comprises a connecting shaft 231 which is attached to the water outlet mechanism 20 and which extends partially out of the outer rotary wall and a bearing 232 that is connected to extending part of the connecting shaft; the auxiliary portion 24 comprises a ball which is arranged to roll with respect to the water outlet mechanism 20, the ball portion extends beyond the outer rotary wall. In the present embodiment, the leading portion 23 and at least one guide portion 24 are arranged at an array of the outer rotary wall axis axes.

In the concrete structure of the water outlet mechanism 20, the water outlet portion 21 includes an inner core 211 which forms a water flow passage and a ball holder 212 fixed to the inner core 211, the inner core 211 is provided with a second main hole 213 and at least one second auxiliary hole 214. And the outer peripheral wall of the ball holder 212 is provided with a rotary groove, the two corners of the ball holder 212 is fixedly connected to the inner wall of the water flow passage by sealing of seal rings. The second main hole 213 and a second auxiliary hole 214 interpose between the two sealing rings, in order to seal the water passage of the second main hole and the inner core and to seal the water passage of the second auxiliary hole and the inner core through the ball holder cooperating with the sealing rings. The ball holder 212 and the second main hole 213 cooperate to form a main fitting groove; and the ball holder 212 and the second auxiliary hole 214 cooperate to form an auxiliary fitting groove. There is provided a loop 25 adapted to be fitted to the outer peripheral wall of the water outlet portion 21, and the outer peripheral wall of the loop 25 constitutes an outer rotary wall of the above-mentioned water outlet mechanism, and the loop 25 is provided with a first main hole 251 and at least a first auxiliary hole 252, the first main hole 251 has a pore diameter larger than that of the main fitting groove port, that is, larger than the diameter of the second main hole 213, then the bearing is set so that it does not come into contact with the wall. The main fitting groove is adapted to provide a connector 253, the connect shaft is a screw 231 with one end extending through the first main hole 251 and attached to the connector 253 to connect the bearing 232, so that the bearing 232 extends integrally out of the outer rotary wall. The outer diameter of the ball 24 is not greater than the diameter of the fitting groove (the diameter of the second auxiliary hole 214) and larger than the diameter of the first auxiliary hole 252 to prevent the ball from coming off. The portion of the connector or/and the portion of the ball is located within the annular groove to limit the axial movement of the ball holder.

In the specific structure of the present embodiment, the water outlet mechanism 20 further comprises a gland 26, the gland 26 is fixedly engaged with the outer wall of the water outlet portion 21 and is urged against the loop 25 to limit the axis of the loop 25 to lock the loop 25, the leading portion, the auxiliary portion, the water outlet portion and the ball holder. The water outlet mechanism 20 also includes a horn joint 27 made of a magnetic material and a check valve 28, the check valve 28 is provided in the water flow passage of the inner core 211 and is urged against the ball holder, and the horn joint 27 is fixedly engaged in the outer wall of the water outlet portion 21 and is connected to the pull hose 22. The inner core 211 of the water outlet mechanism is also connected with a hand shower 29.

Preferably, the end of the socket 12 is provided with a magnetizing means 15 for generating magnetic attraction to the water outlet mechanism. So that when the hose is received into the port of the support mechanism and the horn on the hose is close to the magnet, the hand shower fixed on the hose will be tightly absorbed in the support nozzle by the magnetic force.

Figure 4:
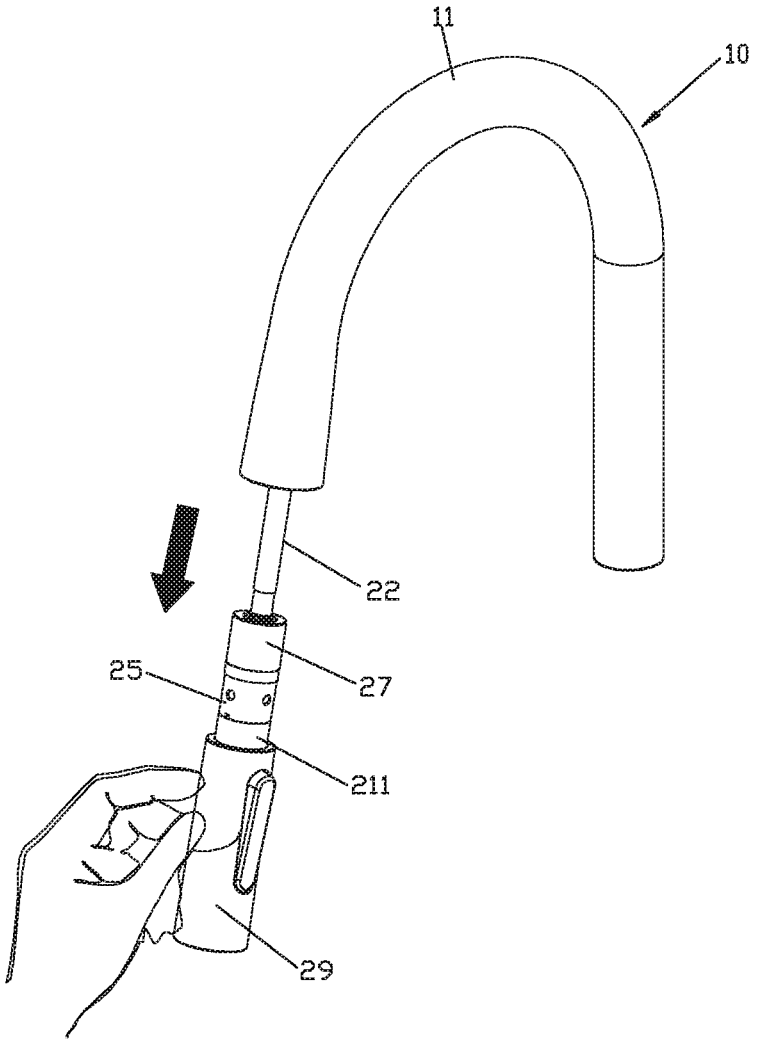
FIG. 4 is a schematic diagram of a manual pull-out water outlet mechanism.
Figure 5:
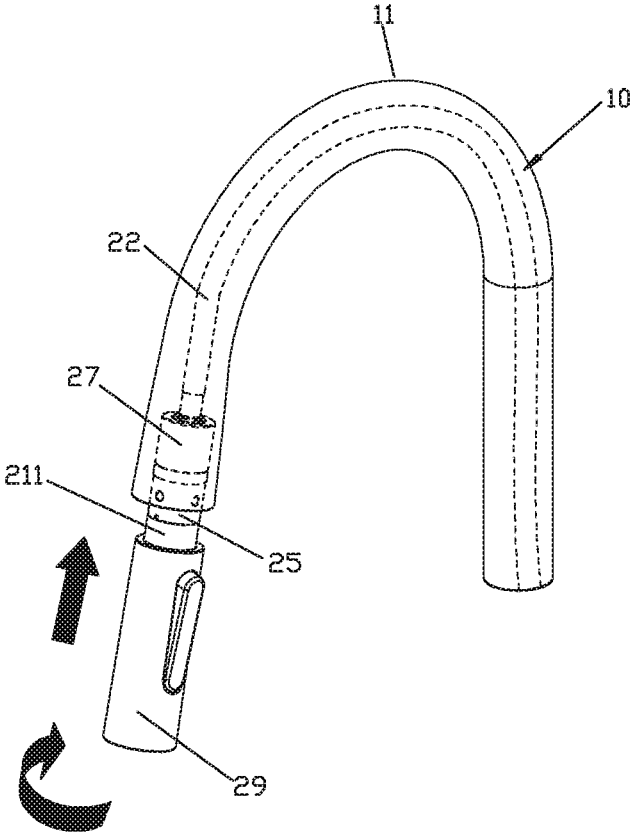
FIG. 5 is a schematic view of the outlet mechanism being pulled back to the support mechanism.
Figure 6:
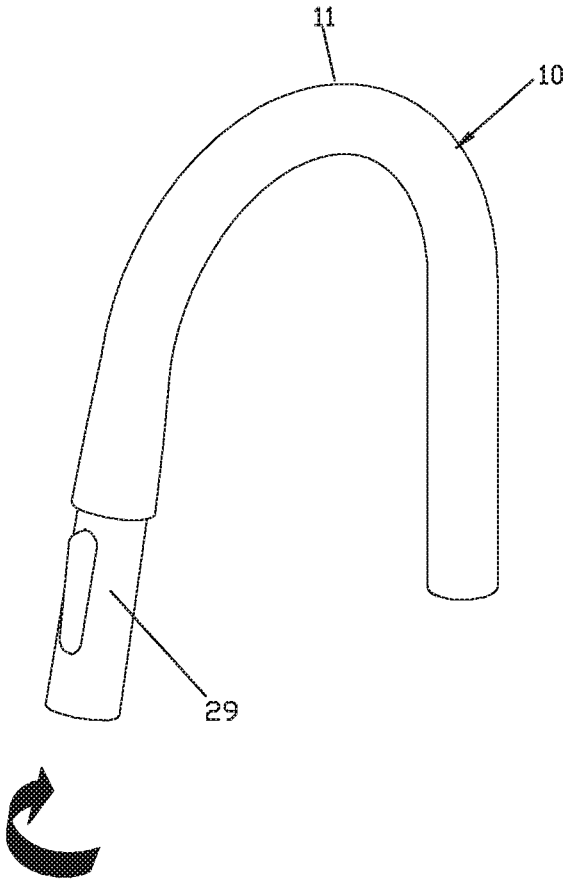
FIG. 6 is a schematic view of the water outlet mechanism pull back to the support mechanism.
Figure 7:
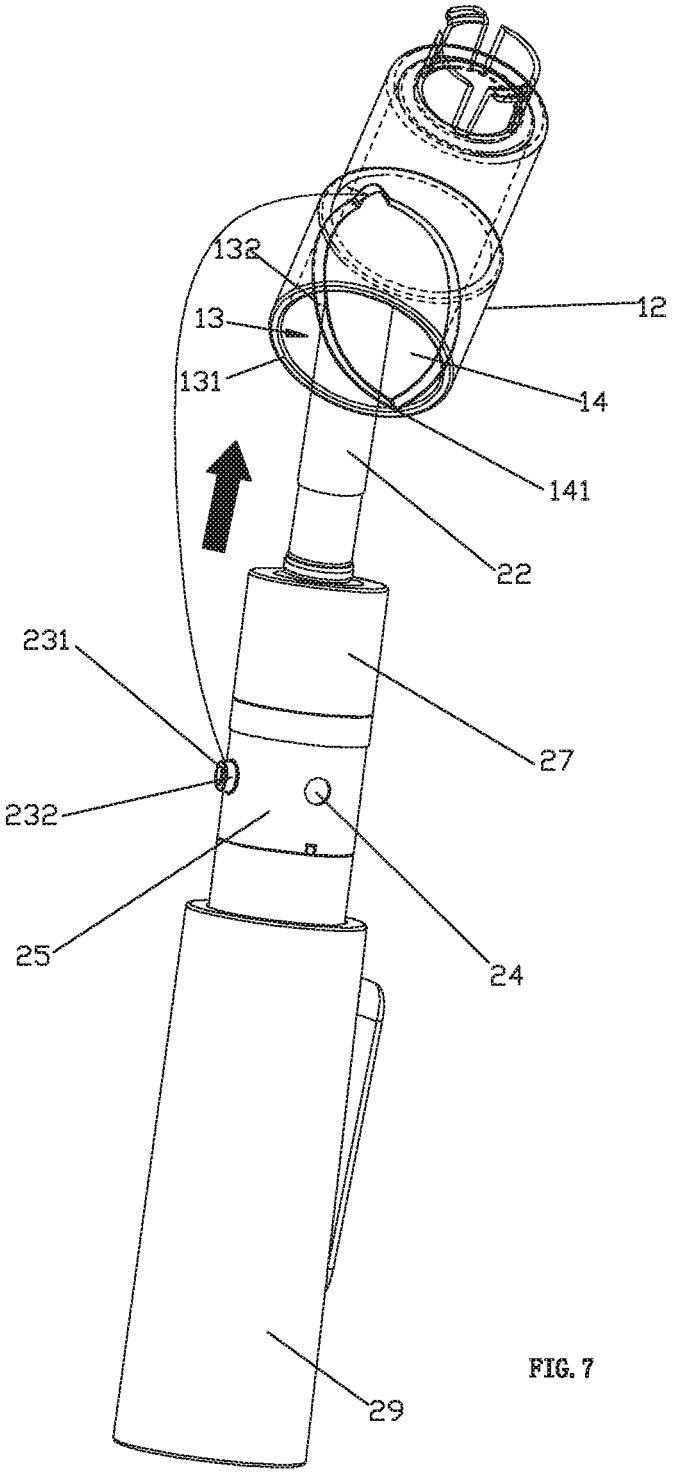
FIG. 7 is a schematic diagram of the combination of the water outlet mechanism and the socket.
Figure 8:
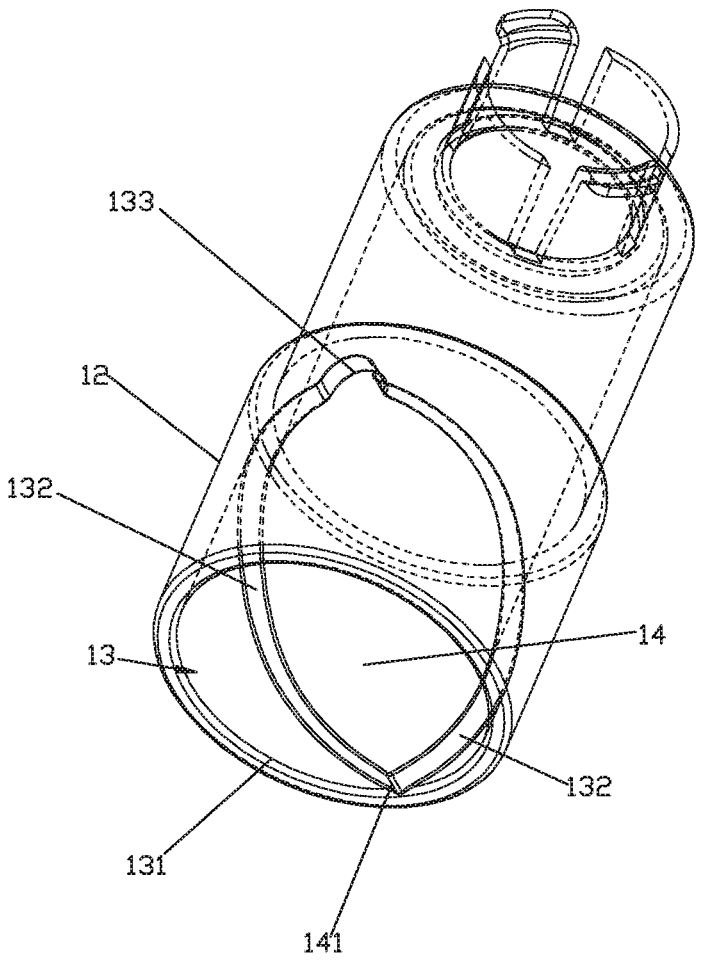
FIG. 8 is a schematic view of the three-dimensional structure of the socket.
Figure 9:
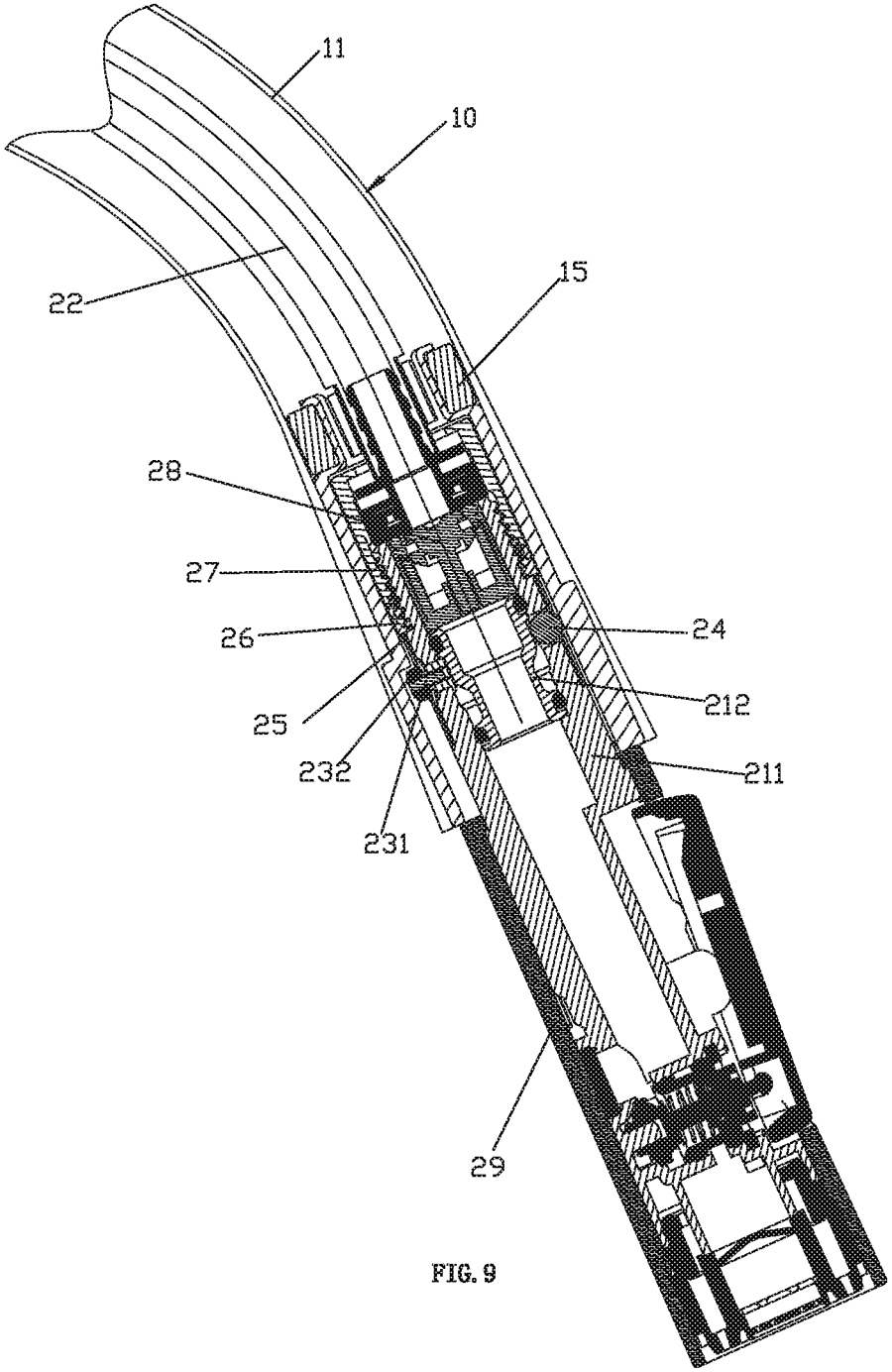
FIG. 9 is a partial cross-sectional view of the water outlet mechanism.
Figure 10:
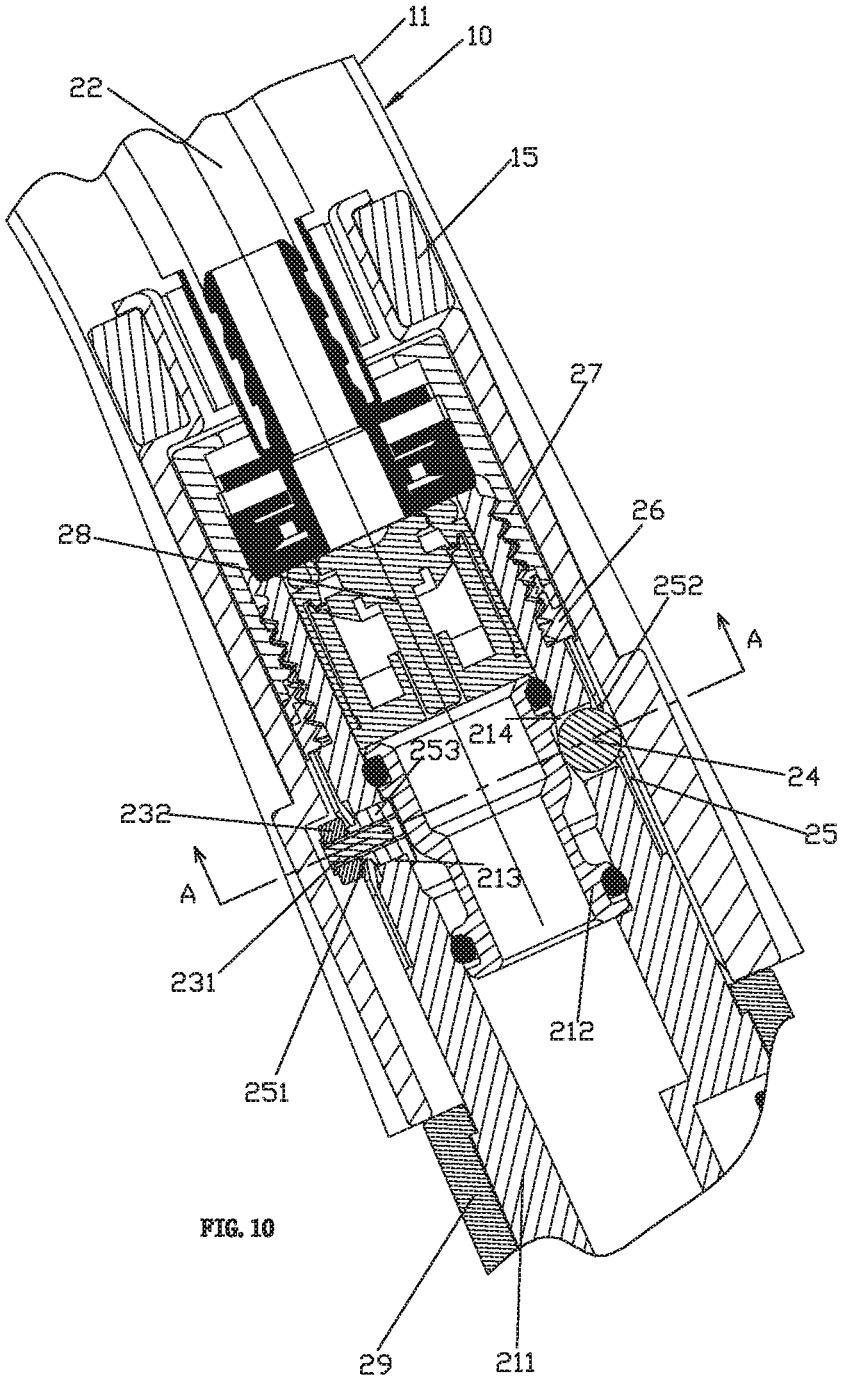
FIG. 10 is a partial enlarged view of FIG. 9.
Figure 11:
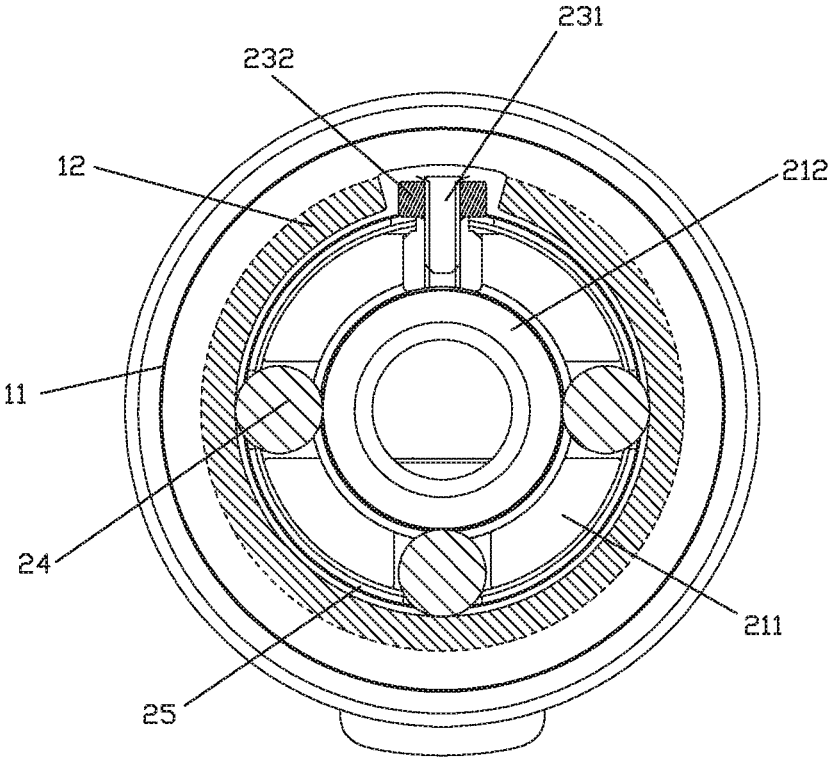
FIG. 11 is a schematic cross-sectional view taken along line A-A in FIG. 10.
Figure 12:
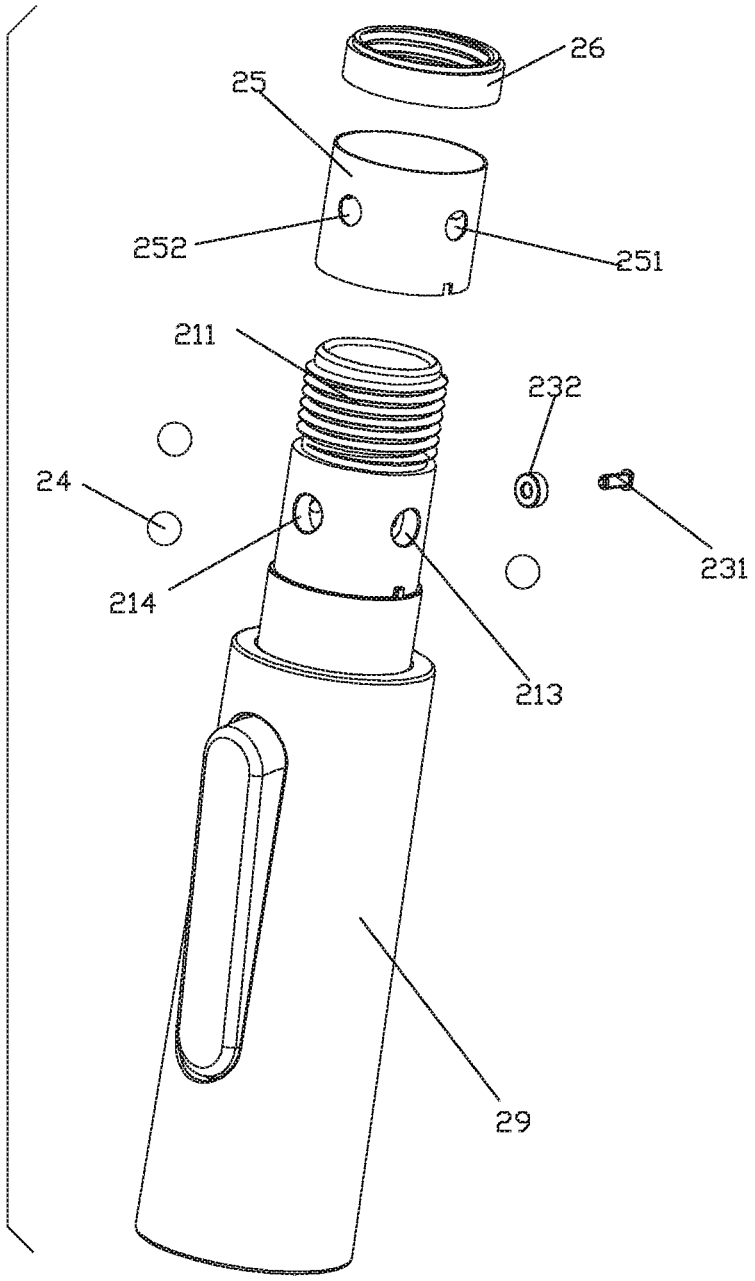
FIG. 12 is a schematic view of the three-dimensional structure of the water outlet mechanism.

Combined with the drawings mentioned above, the principle of automatic guiding of pulling out and pulling back of water outlet mechanism is introduced concretely: 1, as shown in FIG. 4, the hand-held water outlet mechanism 20 with the pull-out hose 22 is pulled away from the support mechanism 10 port at a random angle; 2, as shown in FIG. 5, the hand is released from the water outlet mechanism 20, and under the gravity of the weight 30, the water outlet mechanism is retracted to the port of the support mechanism 10, and the bearing 232 of the leading portion 23 first falls on the groove wall 132 and is rotated axially upwardly along the groove wall 132, the ball of the auxiliary portion 24 rolls on the rest portion 14 of the inner wall and reduce the frictional force of the axial rotation. The magnet ring of the magnetizing means 15 and the horn joint 27 on the hose are magnetically attracted to each other so that the water outlet mechanism is retracted into the port, the bearing 232 on the outlet mechanism falls on the deepest part of the guide groove and falls into the limiting groove, the precision guide is reset to the only direction. The end face of the water outlet mechanism is flattened with the end face of the socket so that the water outlet mechanism is positive and fixed to the pre-set only position where the button is facing forward.

The foregoing is intended only as a preferred embodiment of the present invention, and therefore it is not intended that the scope of the invention be limited thereto, that is, the equivalents of modifications and modifications in accordance with the scope of the present invention and the specification are intended to cover the scope of the invention in the range.

The invention claimed is:

1. A pull-out water outlet apparatus, comprising:

a support mechanism, and a water outlet mechanism, wherein:

the water outlet mechanism comprises a water outlet portion and a pull hose connected to an end of the water outlet portion, the pull hose extends from a port of the support mechanism into the support mechanism, the water outlet mechanism comprises a guide device, the guide device comprises a first guide portion and at least one second guide portion, the first guide portion and the at least one second guide portion extend outwardly from an outer rotary wall of the water outlet mechanism, a height of the first guide portion extending outwardly from the outer rotary wall is greater than a height of each of the at least one second guide portion extending outwardly from the outer rotary wall, an inner wall of the support mechanism comprises a first portion disposed with a guide groove extending inwardly and a remaining portion, the first portion is disposed on the port of the support mechanism, the port of the support mechanism defines an inlet of the guide groove, the remaining portion is spaced apart from the port of the support mechanism, the first guide portion is configured to be guided by the guide groove to a top position of the guide groove, and the first guide portion and the at least one second guide portion respectively abut a bottom of the guide groove and the remaining portion to secure the water outlet mechanism from swinging relative to the guide groove.

2. The pull-out water outlet apparatus according to claim 1, wherein the bottom of the guide groove is disposed with a positioning groove for mounting the first guide portion.

3. The pull-out water outlet apparatus according to claim 1, wherein:

the guide groove comprises two groove walls respectively extending continuously from two sides of the top position of the guide groove and a lowest end of the remaining portion facing the port of the support mechanism, and the two groove walls define a guide surface of the guide groove.

4. The pull-out water outlet apparatus according to claim 1, wherein a lowest end of the remaining portion facing the port of the support mechanism defines a guide structure of the guide groove.

5. The pull-out water outlet apparatus according to claim 1, wherein a central angle of a projection of the inlet of the guide groove in an axial direction is 360 degrees.

6. The pull-out water outlet apparatus according to claim 1, wherein:

the first guide portion comprises a connecting shaft disposed on the water outlet mechanism, at least a portion of the connecting shaft extends outwardly from the outer rotary wall to define an extending portion, and a bearing is disposed on the extending portion of the connecting shaft.

7. The pull-out water outlet apparatus according to claim 1, wherein:

each of the at least one second guide portion comprises a ball configured to rotate relative to the water outlet mechanism, and a portion of the ball extends outwardly from the outer rotary wall.

8. The pull-out water outlet apparatus according to claim 6, comprising:

a loop, wherein:

an outer wall of the water outlet portion is disposed with a first mounting groove extending inwardly, the loop is configured to connect to the outer wall of the water outlet portion, the loop is disposed with a first through hole, a diameter of the first through hole is smaller than a diameter of an inlet of the first mounting groove, the first mounting groove is disposed with a connector, a first end of the connecting shaft passes through the first through hole and is disposed on the connector, and an outer wall of the loop defines the outer rotary wall.

9. The pull-out water outlet apparatus according to claim 6, wherein:

an outer wall of the water outlet portion is disposed with at least one second mounting groove extending inwardly, a loop is configured to connect to the outer wall of the water outlet portion, the loop is disposed with a second through hole, a ball is disposed inside each of the at least one second mounting groove, and a diameter of the ball is not greater than a diameter of a corresponding one of the at least one second mounting groove and is larger than a diameter of the second through hole, and an outer wall of the loop defines the outer rotary wall.

10. The pull-out water outlet apparatus according to claim 8, wherein:

the water outlet portion comprises an inner core defining a water flow passage and a ball holder disposed inside the inner core, the inner core is disposed with a third through hole, a water flow passage between the third through hole and the inner core is sealed through cooperation of the ball holder and at least one sealing ring, and the ball holder and the third through hole cooperate to define the first mounting groove.

11. The pull-out water outlet apparatus according to claim 8, wherein:

the water outlet portion comprises an inner core defining a water flow passage and a ball holder disposed inside the inner core, the inner core is disposed with at least one fourth through hole, water flow passages between each of the at least one fourth through hole and the inner core are sealed through cooperation of the ball holder and at least one sealing ring, and the ball holder and each of the at least one fourth through hole cooperate to define at least one second mounting groove.

12. The pull-out water outlet apparatus according to claim 1, wherein:

the support mechanism comprises a support tube and a socket, the socket is disposed in a front end of the support tube, the socket comprises an accommodating cavity disposed with two openings spaced apart along a length direction of the support tube, an inner wall of the accommodating cavity defines the inner wall of the support mechanism, and a top end of the socket is disposed with a magnetizing device configured to generate a magnetic attracting force that attracts the water outlet mechanism.

13. The pull-out water outlet apparatus according to claim 2, wherein:

each of the at least one second guide portion comprises a ball configured to rotate relative to the water outlet mechanism, and a portion of the ball extends outwardly from the outer rotary wall.

14. The pull-out water outlet apparatus according to claim 3, wherein:

each of the at least one second guide portion comprises a ball configured to rotate relative to the water outlet mechanism, and a portion of the ball extends outwardly from the outer rotary wall.

15. The pull-out water outlet apparatus according to claim 4, wherein:

each of the at least one second guide portion comprises a ball configured to rotate relative to the water outlet mechanism, and a portion of the ball extends outwardly from the outer rotary wall.

16. The pull-out water outlet apparatus according to claim 5, wherein:

each of the at least one second guide portion comprises a ball configured to rotate relative to the water outlet mechanism, and a portion of the ball extends outwardly from the outer rotary wall.

17. The pull-out water outlet apparatus according to claim 5, wherein a diameter of the at least one second guide portion is the same as a diameter of an inner wall of the remaining portion.

* * * * *